US005825394A

United States Patent [19]

Gilbert et al.

[11] Patent Number: 5,825,394

[45] Date of Patent: Oct. 20, 1998

[54] THERMAL PRINT HEAD CALIBRATION AND OPERATION METHOD FOR FIXED IMAGING ELEMENTS

[75] Inventors: J. Mark Gilbert, St. Paul; Randy S. Johnston, Burnsville; Danny J. Vatland, Chanhassen, all of Minn.

[73] Assignee: LaserMaster Corporation, Eden Prairie, Minn.

[21] Appl. No.: 603,548

[22] Filed: Feb. 20, 1996

[51] Int. Cl.[6] ..... B41J 2/35

[52] U.S. Cl. ..... 347/191

[58] Field of Search ..... 347/171, 179, 347/188, 190, 191, 200, 183, 185, 209

[56] References Cited

U.S. PATENT DOCUMENTS

| | | | |
|---|---|---|---|
| 4,396,923 | 8/1983 | Noda | 347/191 |
| 4,540,991 | 9/1985 | Kariya et al. | 346/76 PH |
| 4,573,058 | 2/1986 | Brooks | 346/76 PH |
| 4,717,924 | 1/1988 | Bangs et al. | 347/191 |
| 4,758,966 | 7/1988 | Brooks et al. | 346/519 |
| 4,782,202 | 11/1988 | Sawae et al. | 219/68 |
| 5,109,235 | 4/1992 | Sasaki | 347/183 |
| 5,163,760 | 11/1992 | Nardozzi | 400/120 |
| 5,204,704 | 4/1993 | Genno et al. | 346/76 PH |
| 5,208,607 | 5/1993 | Ohaski et al. | 346/1.1 |
| 5,216,440 | 6/1993 | Aoyagi | 347/184 |
| 5,365,257 | 11/1994 | Minowa et al. | 346/76 PH |
| 5,469,203 | 11/1995 | Hauschild | 347/190 |
| 5,473,356 | 12/1995 | Nisius et al. | 347/191 |
| 5,528,276 | 6/1996 | Katsuma | 347/191 |
| 5,604,526 | 2/1997 | Kwak | 347/191 |

FOREIGN PATENT DOCUMENTS

| | | |
|---|---|---|
| 0 421 353 A2 | 4/1991 | European Pat. Off. . |
| 0 573 923 A2 | 12/1993 | European Pat. Off. . |
| 0 601 658 A1 | 6/1994 | European Pat. Off. . |
| 39 35 661 A1 | 10/1988 | Germany . |

*Primary Examiner*—Adolf Berhane
*Attorney, Agent, or Firm*—Paul H. McDowall

[57] ABSTRACT

A method calibrating a thermal print head printer having fixed imaging elements so that consistent high resolution output may be achieved includes a means for measuring a common characteristic of each fixed imaging element and storing the values so that print head compensation may occur during the printing process one scan line at a time. Error diffusion, either across the thermal print head, downweb, or both, ensures that appropriate drive level are supplied to each fixed imaging element regardless of inherent differences in the common characteristics of the fixed imaging elements, to achieve consistent tonal image quality. In a preferred embodiment, the fixed imaging elements are thin film electrical resistive elements and the common characteristic is the electrical resistance of the thin film resistor elements.

21 Claims, 7 Drawing Sheets

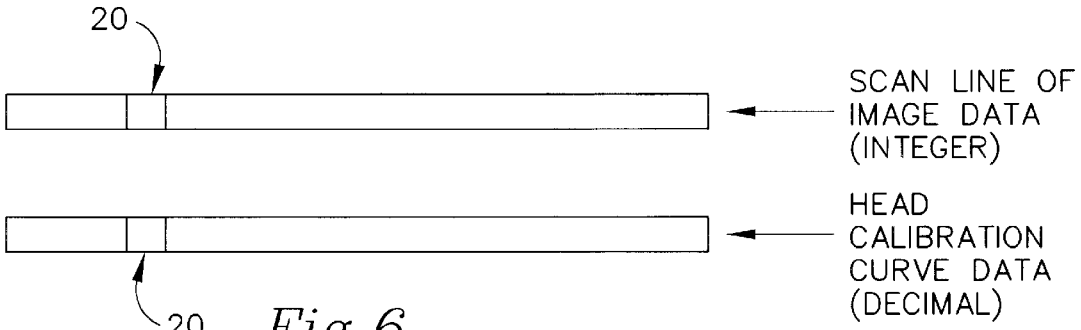
*Fig. 6*
*Fig. 7*
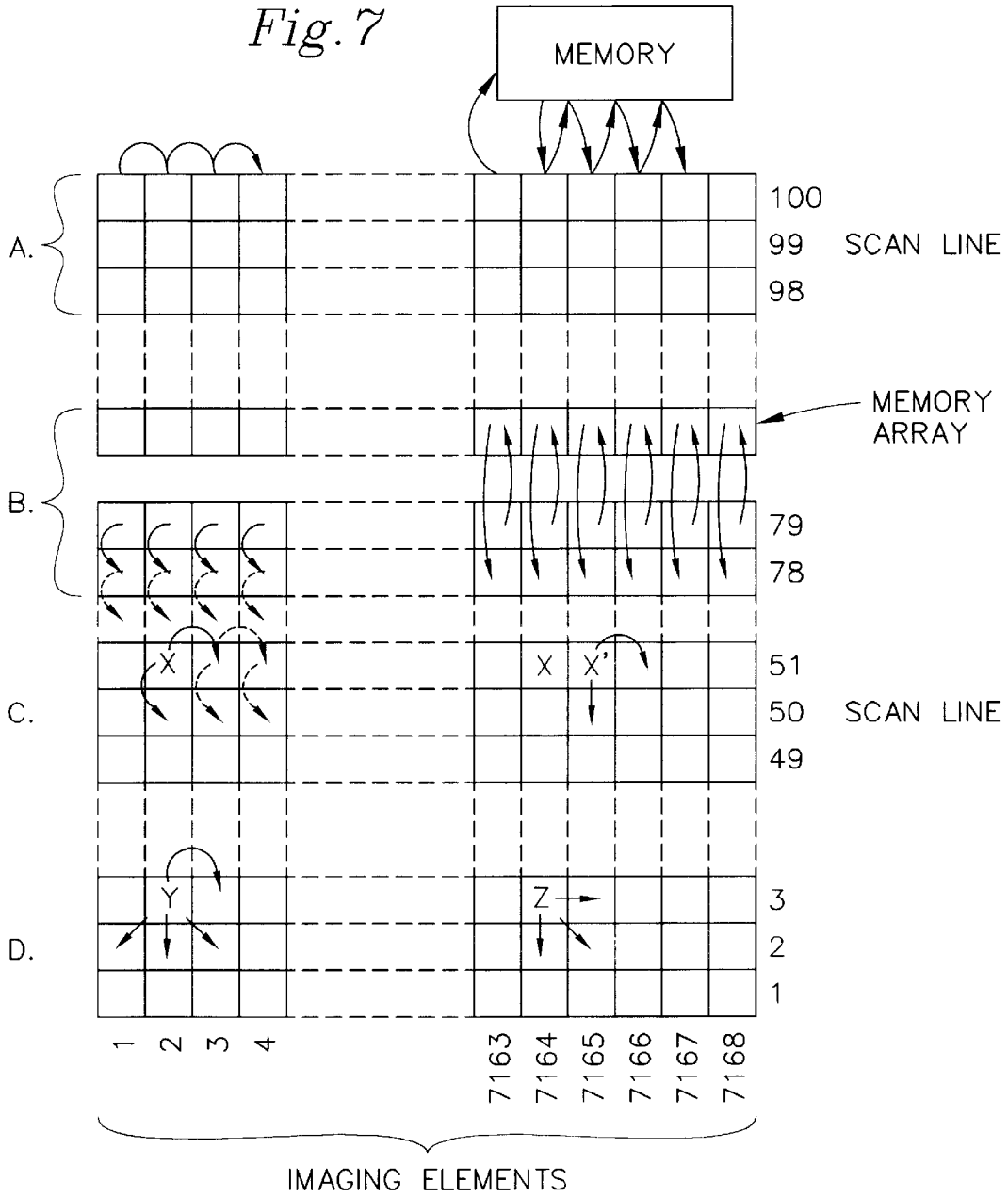

THERMAL PRINT HEAD CALIBRATION AND OPERATION METHOD FOR FIXED IMAGING ELEMENTS

FIELD OF THE INVENTION

This invention relates to thermal printing systems, and, more particularly, to a new and improved method of calibrating a plurality of fixed imaging elements driven by a quantized thermal printing control apparatus. The calibration method of the present invention addresses numerous problems of prior art thermal printing systems as well as numerous problems discovered in the design of graphics quality thermal digital imaging printers that employ fixed thermal elements in thermal communication with a print medium.

BACKGROUND OF THE INVENTION

The present invention relates to a method for calibrating and controlling thermal printers, preferably to provide binary images having consistent tonal gradient and hue across a printed image. More specifically, the present invention deals with a method for compensating for differing performance characteristics present among discrete fixed imaging elements closely situated together for marking a thermal imaging medium under controlled electrical activation.

Thermal printing, is typically achieved by incrementally moving or "stepping" a print medium transverse to a stationary thermal imaging print head. The thermal print head frequently includes a plurality of heating elements arranged in a linear array perpendicular to the direction of movement of the printing substrate. The stepping size if often chosen to equal a spacing or "pitch" between the heating elements. For example, printers with 300 dots per inch (dpi) thermal print heads (i.e., having a pitch of 1/300th of an inch) frequently step the print media past the thermal head at 300 equal increments per inch. A picture element or pixel generally refers to a coverage area defined by this stepping resolution in the "vertical" or y-direction relative to a print head fixed in the x-direction, and the number of discrete marks producible by the thermal print head in the "horizontal" or x-direction.

The heating elements are generally electrically resistive elements each driven with a separate controllable electrical current flowing through the resistor (a "drive level"), or in the absence of a controllable electrical current, the drive level is adjustable by controlling the on/off period for a preselected constant electrical current flowing therethrough. A print controller selectively controls the respective heating element response by activating the heating elements as desired during each single advance of the printing medium. Each single advance of the printing medium typically is known as a "scan line" and thus raster image processed printing information is supplied to the thermal print head one scan line at a time. Different heating elements are thus activated in accord with the data carried by each scan line and as the printing medium advances a two-dimensional image forms on the print medium. The printing elements operate to create marks on the printing medium either directly upon a thermally responsive printing medium, or indirectly through donor media which is then used to image another printing medium. The first case is known as "direct thermal printing" wherein the printing medium changes appearance in selected locations corresponding to the selectively energized heating elements. In the later case, "donor printing" or "thermal transfer printing," selective heated portions of the donor medium transfer their image onto another printing medium. The donor medium may be a ribbon coated with a wax, resin-based substance, or ink which melts in a known or controllable manner due to the heat provided by the fixed imaging elements.

There is a continued desire in the art of thermal printing with fixed imaging elements to provide control signals to the fixed imaging elements so that the overall image quality does not vary either between individual adjacent imaging elements that possess differing physical qualities or between imaging portions spaced from one another on the thermal print head. Thus, a need exists for a method of periodically calibrating the thermal print head with reference to its current electrical state and each incoming scan line of rasterized image data so that differences in electrical characteristics among the imaging elements may be adequately compensated and consistent tonal gradient and hue values are formed therefrom.

Digital printing involves placing a number of tiny dots onto particular locations on a printing medium. Any number of these small dots, when viewed some distance away from a printing medium such as film or paper, are perceived as a continuous-tone visual image. Both text and graphic images may be printed with thermal imaging methods so that such "continuous tone" visual images may be created from digital print engines capable of printing half-tone images. Generally, however, a thermal print engine driving fixed imaging elements can drive each said imaging element only to in integer drive level value, thus causing undesirable, abrupt tonal or color transitions in the printed output. Thus, these abrupt boundary artifacts between adjacent imaging elements in an image distract from the overall image, even for monochrome imaging techniques.

Manufacturing variation and electrical artifacts may also cause thermal print head tonal imaging inconsistency. Often, imaging elements that pass stringent specification and quality testing relative to the difference in the value of electrical resistance of adjacent imaging elements within a print head, as well as relative to overall variation among the group of resistor elements making up the thermal print head, can nevertheless possess extremely variable electrical characteristics.

Print engines that typically use the four subtractive primary colors: cyan, yellow, magenta and black ("CYMK") rely upon color blending of these four ink colors to achieved through two mechanisms. For a thermal print engine that first images upon a film substrate medium the printer sequentially images a number of separations so that later when multiple colors of ink are applied to form a colored print, each separation overlays the other exactly and thus a single pixel location can receive more than one color of ink. Upon combining ink colors at a given pixel that a particular color combination can be formed by having multiple ink colors at a particular pixel location.

With reference to the perceived "continuous tone" image phenomena described above, rather than perceiving individual magenta and yellow dots formed by a digital printing engine, the eye will blend the adjacent dots to perceive a continuous orange image where in fact more than one ink color combines at each discrete pixel within the image area. Often a substantial number of the pixels of the image will go without having a (lot of ink placed on them. This allows the perceived visual image to have a proper lightness/darkness value.

As one of skill in the art appreciates, contone print engines may utilize the method of the present invention as long as they are capable of producing a single, preselected grey value among a continuum of grey values which are all reproducible for a given resistor drive level. Furthermore, it is to be understood that contone printing may occur with either donor or direct imaging in accord with the present invention.

Thus a need exists for a method of compensation for differences in the electrical properties of individual thermal printing elements so that formerly unusable thermal print head arrays may be controlled to provide satisfactory output thereby decreasing the criticality of certain thermal print head manufacturing specifications and quality assurance parameters. Furthermore, a means of appropriately compensating for and accommodating certain fault conditions in discrete thermal imaging elements would be desirable so that a degree of fault tolerance is exhibited in thermal print heads controlled to image high resolution images.

SUMMARY OF THE INVENTION

The head calibration technique of the present invention may be performed as an initial setting by the manufacturer of a thermal print engine using conventional computer processing techniques operated to control drive signals to a plurality of fixed imaging elements. Furthermore, an end-user may initiate the present method to adequately compensate the thermal characteristics of the fixed thermal print elements. A preferred embodiment of the present invention includes a user-selectable switch for periodically calibrating the entire length of the linearly oriented thermal imaging elements for acceptable tonal consistency of dithered images and contone images, including donor or direct thermal printing.

In the preferred embodiment of the present invention, a plurality of discrete thermal imaging resistor elements electrically couple to drive level control circuitry which includes appropriate circuitry for instantaneously measuring the electrical resistance of each resistor element. Thereby an end user may select to characterize the present state of the thermal print head which then causes the measurement and storage of the values of electrical resistance presently exhibited by the fixed imaging elements. Thereafter when the raster image processed data is compensated for the vagaries of changing or differing thermal print head characteristics and then subjected to the error diffusion in accordance with the present invention, optimal print duality occurs.

In preferred embodiments, the controller controls the operation of each of the resistors so that as each scan line of a rasterized image is received by the controller, reference is made to the then-current head calibration curve for the thermal print head so that compensated drive level data can be generated, this ideally compensated data is then subjected to an error diffusion procedure to produce quantized drive levels to even any disparities among adjacent resistor elements so that the final output bears few undesirable abrupt color or tonal transitions. Thus reproducing the ideally compensated source image over a local image portion or area. In this embodiment, the error diffusion procedure may comprise either a cross-head or down-web dispersion of error signals, or both cross-head and down-web dispersion of error signals.

In other embodiments, the controller monitors the resistance of the resistors and indicates degradation or failure of any individual resistor when either an open or closed circuit reading occurs. A preselected defect compensation and tolerance feature may be used for added utility, once such resistor degradation or failure becomes manifest. Thus, corrective action may be initiated by the end user prior to printing with a faulty thermal print head.

The following drawings are representative of certain embodiments of the present invention and as such should be viewed as illustrative and not limiting to any particular embodiment of the invention, nor are the drawings representative of the relative scale of the features depicted therein.

BRIEF DESCRIPTION OF THE DRAWINGS

FIG. 6 is a depiction of scan line source image data and corresponding head calibration data showing that the scan line image data is integer data for a linear thermal print head and the corresponding set of compensated drive level data for the same thermal print head.

FIGS. 7A 7B, and 7C/7D depict cross-head error diffusion, down-web error diffusion, in a combination of both cross-head and down-web error diffusion respectively; all of which may be used for printing with a thermal print head having fixed imaging elements in accordance with embodiments of the present invention.

DETAILED DESCRIPTION OF THE PREFERRED EMBODIMENTS

Figure 1:
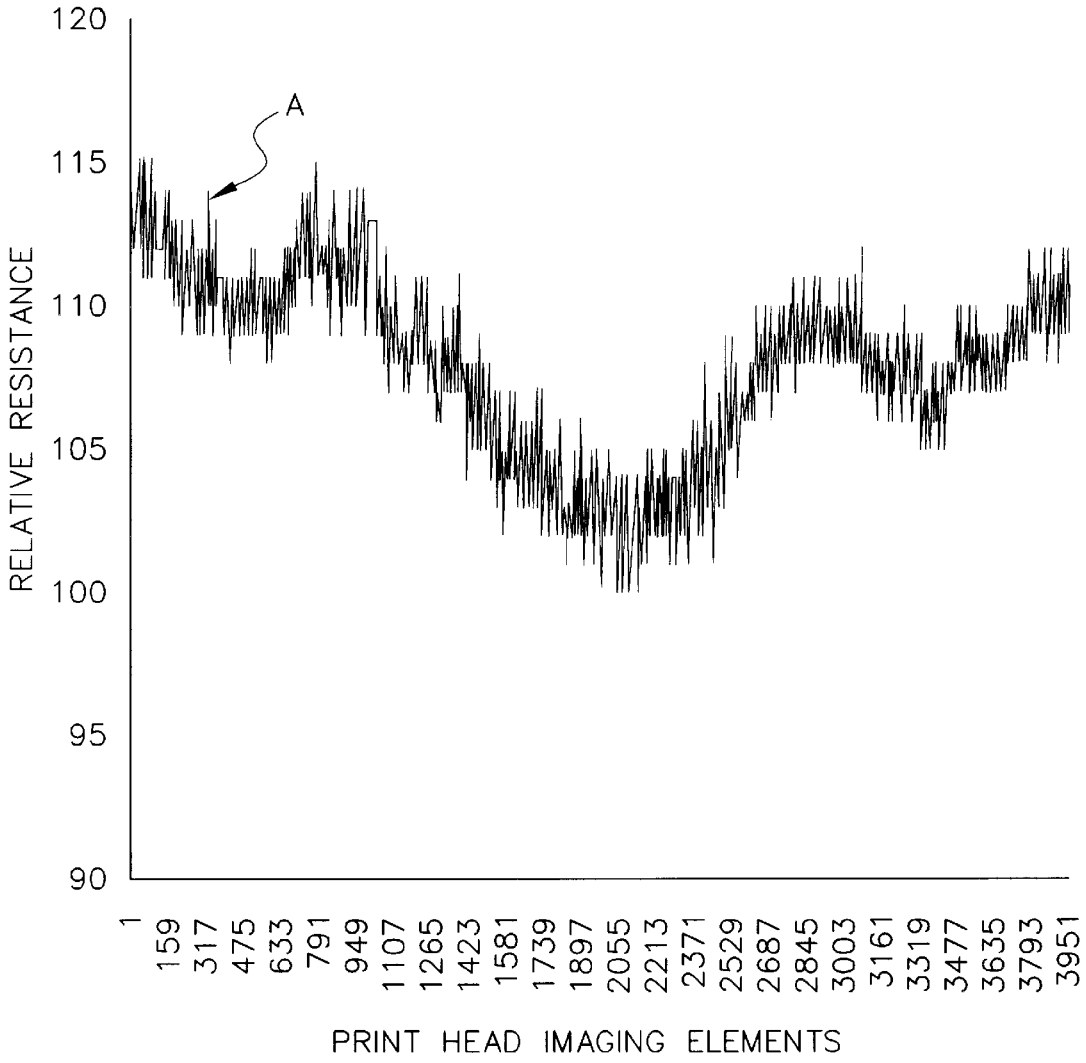
FIG. 1 is a graphical depiction of relative electrical resistance values of approximately 4000 individual fixed thermal imaging elements disposed upon a linear thermal print head.
Figure 1A:
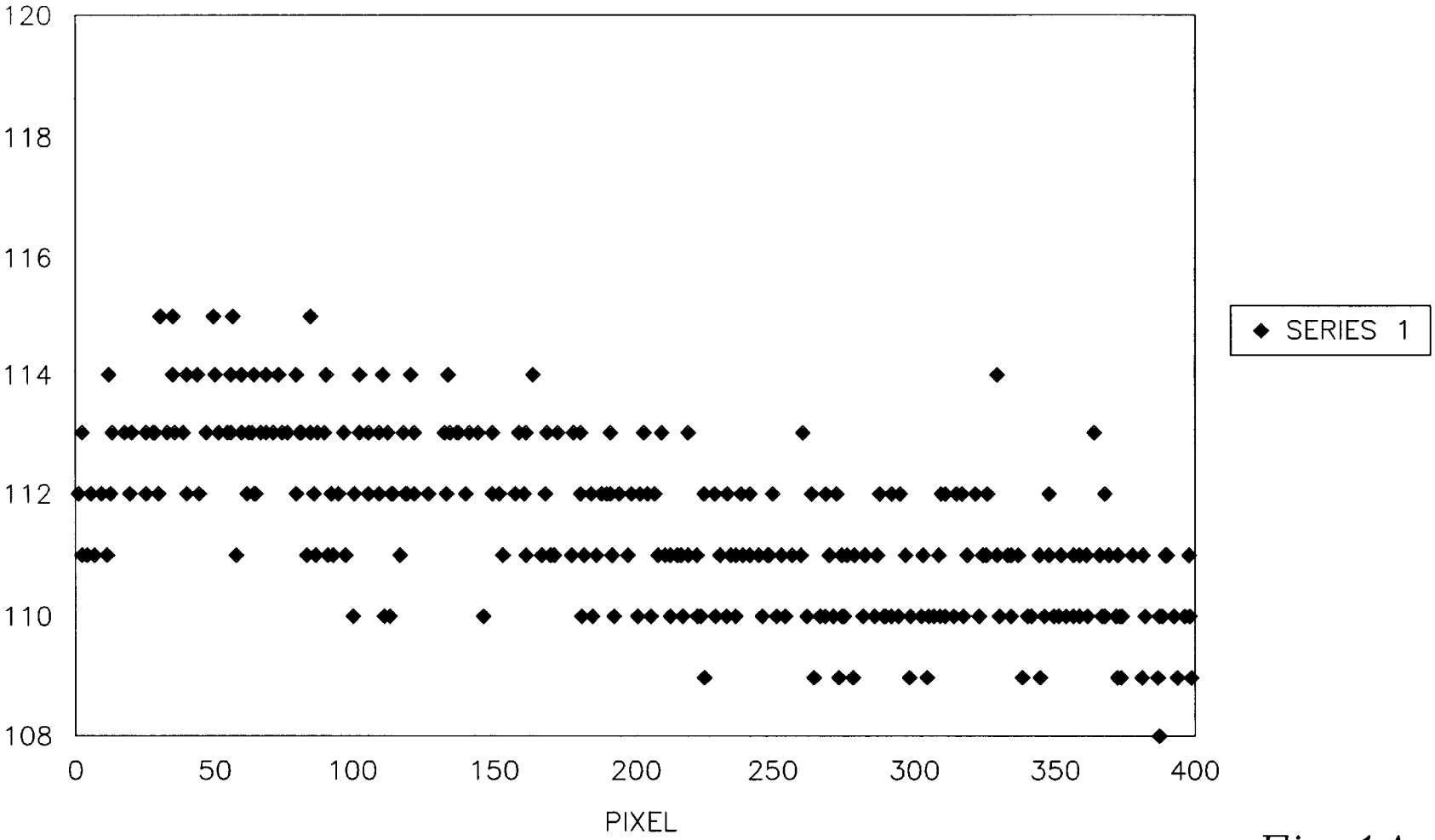
FIG. 1A is a graphical depiction of relative electrical resistance values of approximately 400 of the individual fixed imaging elements depicted in FIG. 1.

With reference to FIG. 1 depicting a plurality of traces on a graph where the ordinate corresponds to a measure of the resistance of each fixed imaging element 20 versus the abscissa length values relate to the width of a given thermal print head 10. Each of the line segments appearing vertically in FIG. 1 denote a plurality of discrete measurements of individual fixed imaging elements 20. One such segment is denoted by the letter "A" and upon careful scrutiny can be seen to represent actual measured values of electrical resistance of a significant number of fixed imaging elements 20. A second representation of electrical resistance values of related to those shown in FIG. 1 appears in FIG. 1A and represents approximately 400 imaging element resistance values, so the reader can appreciate that adjacent imaging elements 20 possess differing values of electrical resistance which ideally would accept printing control signals tailored to produce a desired drive level value calculated to fully compensate the print head for discrepancies in the measured values of electrical resistance of the fixed imaging elements 20. A desired drive level typically is selected on the basis of the consistent thermal output it produces in comparison to other imaging elements of the thermal print head 10.

Figure 2:
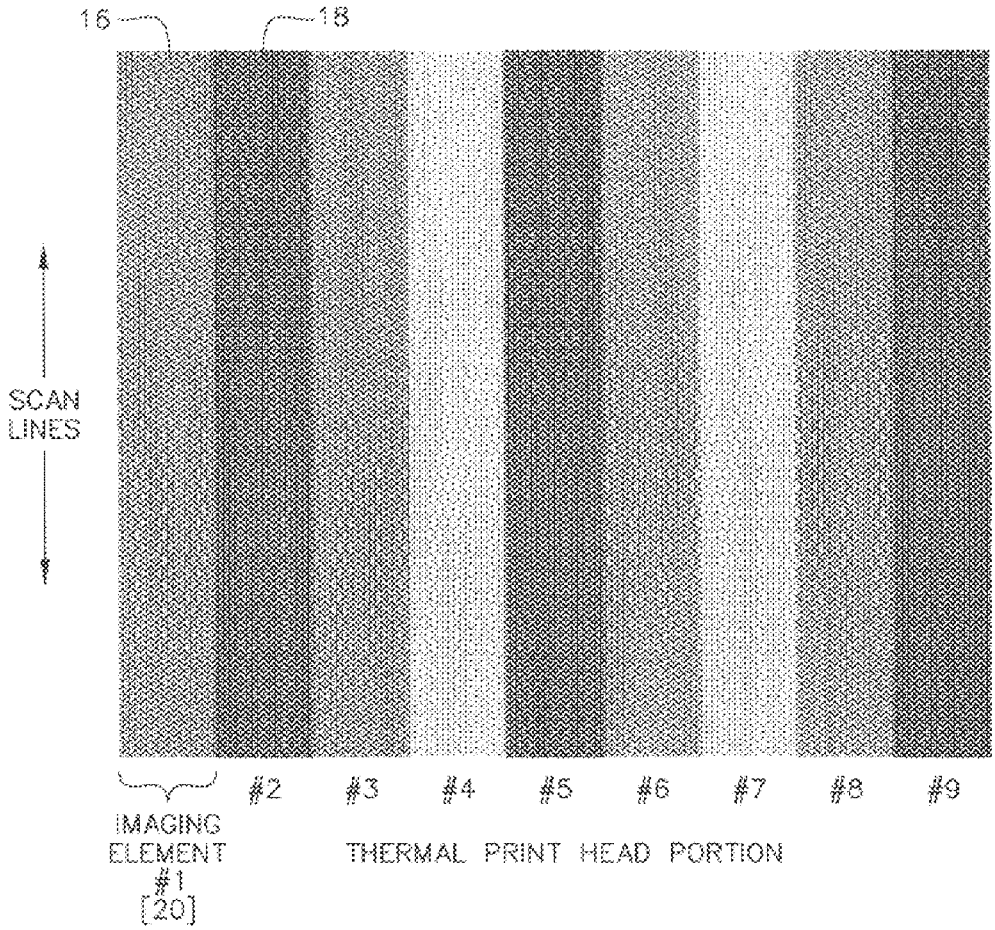
FIG. 2 is a greatly enlarged depiction of a portion of thermal film output created with a linear thermal print head without head calibration techniques of the present invention and illustrating differing tonal image portions produced by each of the nine adjacent resistive imaging elements depicted therein where the thermal print head is driven at integer drive level values.

Present manufacturing techniques for thermal print head imaging elements has a practical limit of 600 discrete imaging elements per inch. As illustrated in FIG. 2, when these imaging elements are driven at integer drive level values they unfortunately render discernible differences from one fixed imaging element area 16 to another adjacent fixed imaging element area 18. The present invention allows the thermal print elements 20 to be driven at a much more consistent resolution across the entire footprint of thermal print head 10 with drive level accuracy approaching that achieved with floating point decimal drive level values.

Figure 3:
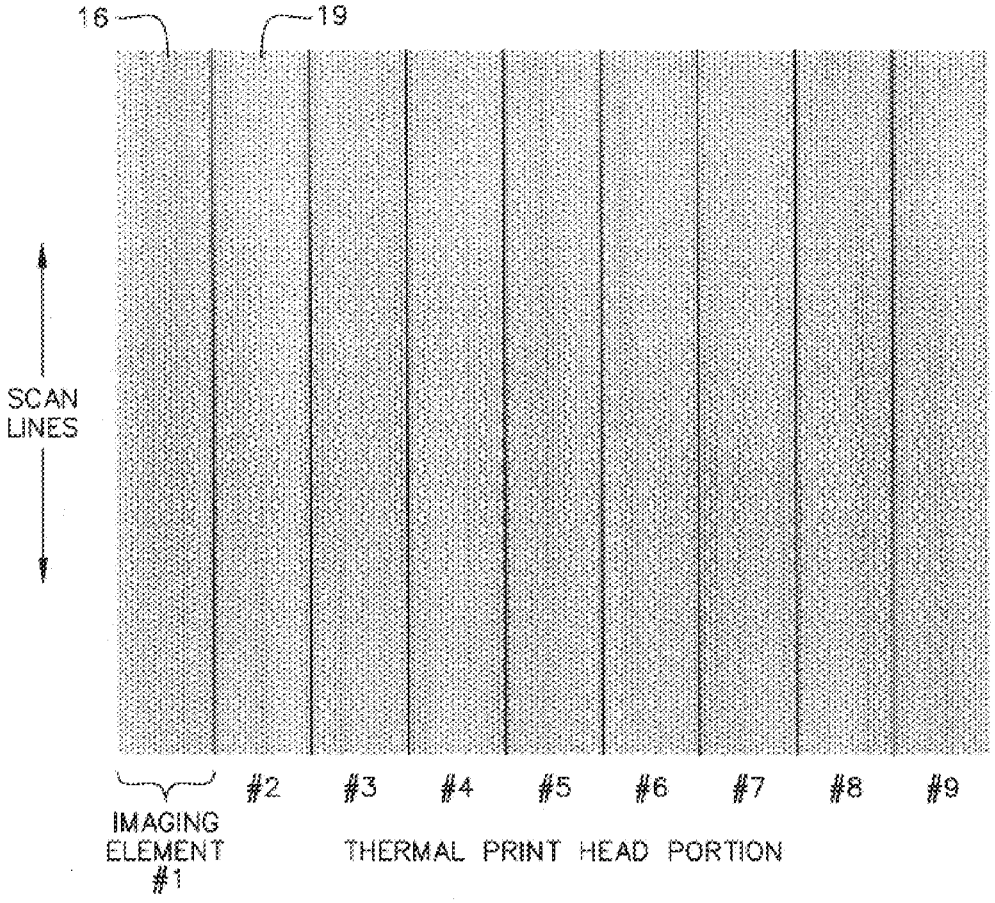
FIG. 3 is a greatly enlarged depiction of a portion of thermal film output created with a linear thermal print head using the head calibration techniques of the present invention illustrating consistent tonal image portions produced by each of the nine adjacent resistive imaging elements depicted therein where the thermal print head is driven by a control apparatus using the head calibration and operation techniques of the present invention.

With reference to FIG. 3, when the imaging elements are driven in accordance with the present inventions also at integer drive level values and including error diffusing the remainder difference between a calculated optimal drive level value and the integer drive level value, very consistent tonal output having no discernible hue transitions results. Thus with use of the present invention, no discernible differences occur at the boundary between one fixed imaging element area 16 to another adjacent fixed imaging element area 19. Note that the vertical white lines of FIG. 3 were added for ease of visual inspection to show separation among the imaging elements 20 depicted in FIG. 3 and are not an artifact of the present invention. The instant invention allows the thermal print elements 20 to be driven at a much more consistent resolution across the entire footprint of thermal print head 10 with drive level accuracy approaching that achieved with floating point decimal drive level values.

Figure 4:
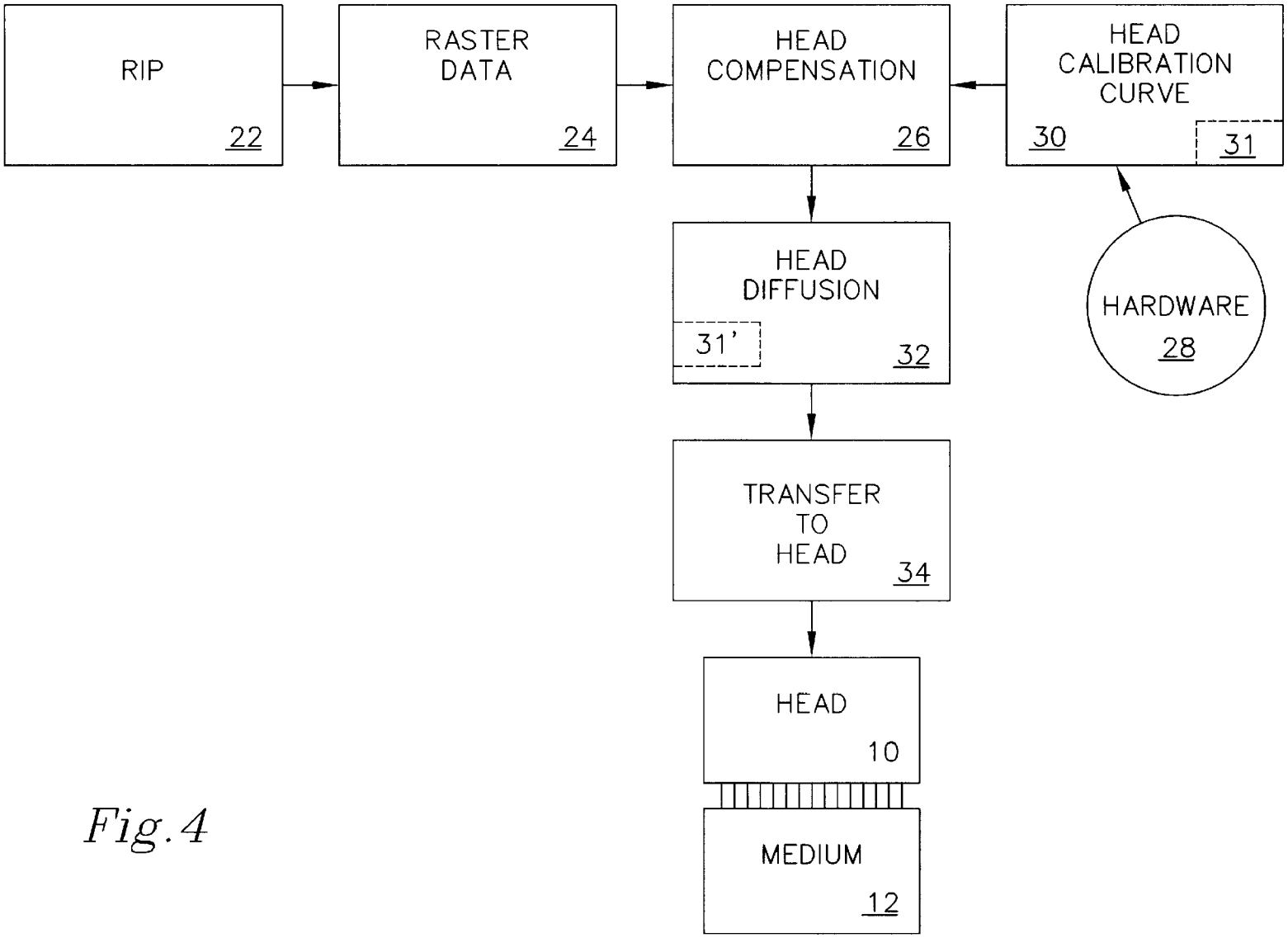
FIG. 4 is a flow chart depicting an embodiment of the head calibration and operation technique of the present invention.

With reference to FIG. 4, the present invention operates by receiving raster data 24 from a raster image processor or source 22, one scan line at a time. As is known in the art, the raster data may be at an arbitrary resolution. The scan line data is then compared to head calibration data 30 stored in a memory storage unit 31 associated with head calibration curve data module 30. The calibration curve data relates to the actual electrical resistance of each discrete resistor associated with the thermal print head 10. The scan line data stream exiting from the calibration curve data module 30 is then compensated scan line by scan line. As each scan line exits the head compensation module 26 it is then subjected to an error diffusing process module 32. The error diffusion process module 32 may take many forms as is known in the art.

In a preferred embodiment of the invention illustrated in FIG. 7B, the error diffusion process module 32 spreads the error down-web of the print medium 12, transverse to the axial direction of the print head 10, thus propagating the error among a common fixed imaging element 20 from one scan line to the next scan line. Thus a memory array for storing the error values of each fixed imaging element between each pass, or scan line processing, allows consistent imaging element compensation throughout the printed output. Notably this error value will therefore be tailored to the nuances of each individual imaging element and although memory and processing resources are expended, highly consistent tonal output is generated in this embodiment.

In another embodiment shown in FIG. 7A, the error diffusion process module 32 spreads the error across the print head 10, transverse to the direction of the printing medium 12, thus carrying the error from a fixed imaging element 20 to the next adjacent imaging element. Economy of system resources is the hallmark of this embodiment, since only the previous error value must be stored prior to being applied to the next selected imaging element. However, a person of skill in the art will recognize that the processing sequence may be altered further to accommodate processing of all optimum drive levels and then calculate all the error values for each imaging element, prior to actually operating the fixed imaging elements. In this embodiment, when the last imaging element 20 receiving a scan line receives its input from error diffusion process module 32, the error, or remainder over an integer value, is dropped so that the next scan line begins without any error carryover from the previous scan line. The scan line data then is then preferably transmitted to the printer head 10 via a head transfer module 34.

In a further embodiment shown in FIG. 7C and 7D, both cross-head and down-web error diffusion are used in a serial processing sequence one after the other, or are operatively interlaced, so that consistent tonal image quality is assured. In a preferred form of this embodiment fractional portions of the error remainder for a given imaging element are applied to adjacent imaging elements, including the given imaging element and its adjacently neighboring imaging elements for the next scan line processing sequence. Persons skilled in the art will recognize that variations in processing the error, or remainder difference, may be made that differs from the embodiments herein described, but nevertheless falling within the gambit of the present invention.

Figure 5:
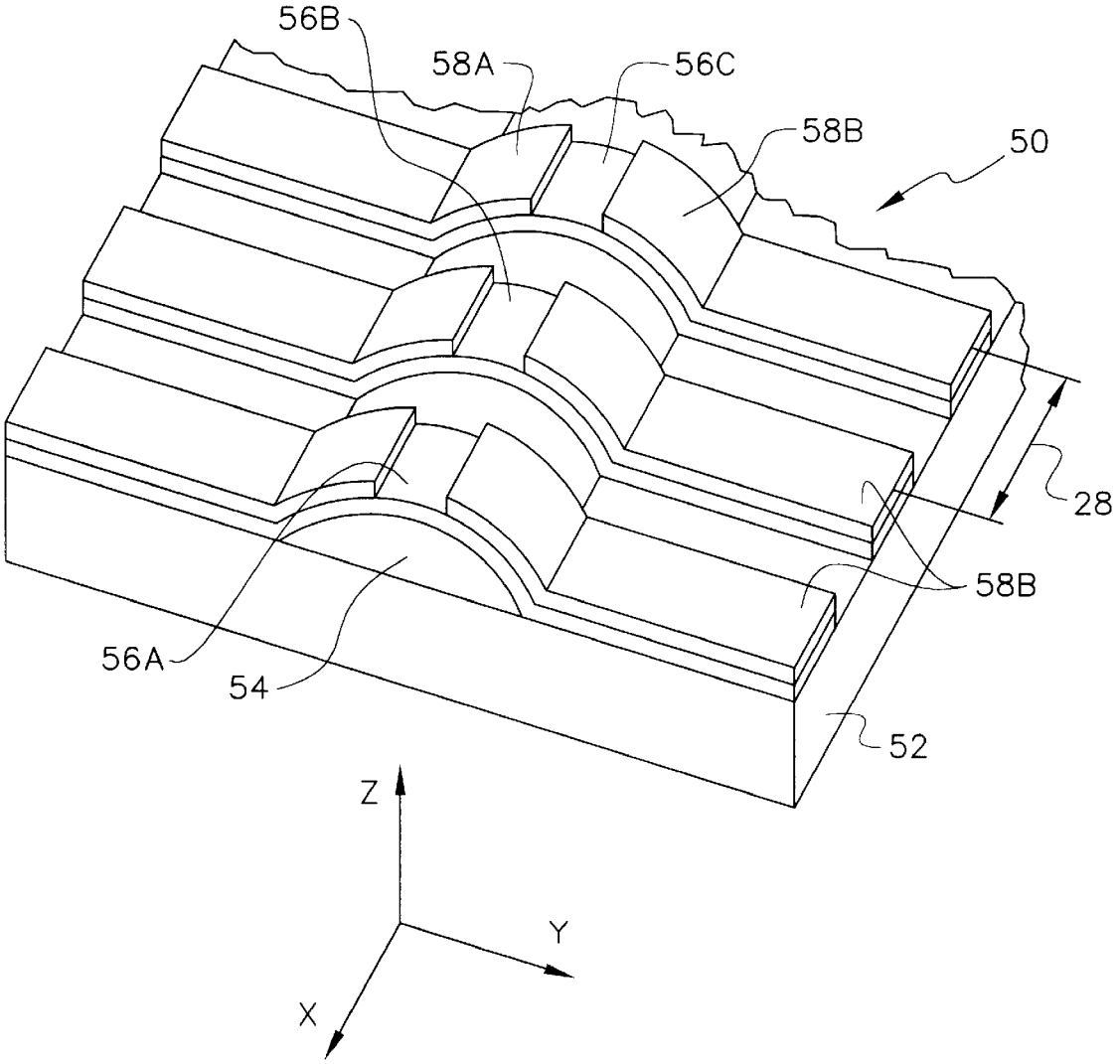
FIG. 5 is a perspective view of a portion of a typical thermal print head having a plurality of thin film resistor imaging elements.

A greatly enlarged perspective view of a portion of a thermal print head 50 is shown in FIG. 5. FIG. 5 is purposely drawn out of scale, particularly as to the thickness and size of various layers, to better contrast the various elements. The thermal print head 50 or other types of thermal print heads may be found in various thermal printers. Thermal print head 50 is particularly contemplated for use with the thermal printer described in co-pending application Ser. No. 08/285,059 for HIGH RESOLUTION COMBINATION DONOR/DIRECT THERMAL PRINTER by Leonard et al., which is commonly assigned and hereby incorporated by reference herein.

The thermal print head 50 is formed on a conventional substrate 52 such as alumina or ceramic. A glaze layer 54 is positioned on substrate 52 with resistive heater elements 56 positioned on the glaze layer 54. An electrical conductor layer 58 is then positioned on each heater element 56 to complete separate electrical circuit through each heater element 56. The conductor layer 58 is a conventional electrical conductor used in thin or thick film processing such as gold. Heater elements 56 are conventional thin film or thick film resistors. The pitch 28 between adjacent heater elements 56*a*, 56*b*, 56*c*, in the preferred embodiment print head is 1/600th of an inch (i.e., 600 dpi).

It is recognized that other types of thermal print heads exist which differ from that shown in FIG. 5. The size, shape, and orientation of all the various components shown may be altered as desired by those skilled in the art. A glaze may be placed over the entire line of heater elements 56. The heater elements 56 may not be linearly arranged but rather may have some y-offset between adjacent elements. The array of heater elements 56 may be disposed at an angle relative to the direction movement of printing medium 12. In another embodiment, the thermal print head 50 may he moved in the y-direction relative to stationary printing medium 12. Other modifications may he made to thermal print head 50. With respect to inventive methods and apparati for controlling a thermal print head, U. S. patent application Ser. No. 08/298,936, "Method and Apparatus for Controlling a Thermal Print Head," filed 31 Aug., 1994 is hereby incorporated by reference herein. Furthermore, U. S. patent application Ser. No. 08/299,291 "Heating Control for Thermal Printers," filed 31 Aug., 1994, is hereby incorporated by reference. Both the aforementioned patent applications are commonly assigned to LaserMaster Corporation, Eden Prairie, Minn., USA.

The exact drive level determined in accordance with the present invention must he calculated, compensated, but is not actually communicated to a fixed imaging element 20. The exact drive level equals the magnitude of electrical resistance of an imaging element 20 multiplied by the nominal drive level derived from the head calibration curve "A" to achieve the tonal qualities inherent in each imaging element 20, and a remainder initially set to zero (0) and thereafter handled as the net difference between the an integer value drive level closest in magnitude to the exact, or desired, drive level for the thermal imaging elements 20. Incrementing one (1) step to the next adjacent imaging element 20 and then repeating the process so that the drive level is set to the exact drive level - given the calibration data set for the element 20 and adding in the remainder from the drive level calculation used for the immediately previous imaging element the tonal transitions are smoothed across the entire width of the thermal print head 10.

To reiterate, the drive levels as defined herein define the level of heat delivered to a given thermal imaging element 20 to cause it to print an appropriately sized dot on a thermally sensitive medium 12. The present invention applies the prior art technique of setting drive levels to an arbitrary range of integers, or other regularly spaced drive level values to accomplish differing levels of tonal gradation in the final thermally imaged output. Quite often, however, the exact drive level required to supply to a given fixed thermal element 20 resides at a value between two of the arbitrarily set drive level values. If the designer chooses a "nearest" integer value, the compromise in consistent performance of the thermal print head 10 often appears in the image formed between adjacent imaging elements 20 as discontinuous hue portions. Furthermore, differences among fixed thermal elements 20 disposed on different portions of the thermal print head 10 may be quite dramatic, with a net result that easily discernible variations in the tonal values of the imaged output occurs. By dispersing the error, or "remainder" defined as the difference between the exact drive level and the chosen integer drive level, over the entire print head 10 these effects are greatly reduced. When implemented on a suitable graphics-quality computer workstation or other similar computing platform, the present invention rapidly and consistently transfers rasterized image data scan line by scan line so that appropriately consistent tonal quality images are rendered on a thermal marking print engine.

Thus the method of calibrating a linearly oriented thermal print head, for each scan line of a digitized raster image, comprises the steps of:

A. measuring the electrical resistance of a select one of a plurality of fixed imaging elements with a circuit means for measuring and storing in a first memory structure the value of electrical resistance of the select one of the plurality of fixed imaging elements;

B. deriving a drive level for an image to be printed from a first segment of rasterized data, said first segment of rasterized data based upon a present input value of a raster image data set corresponding to the select one of the plurality of fixed, adjacent imaging elements:

C. adjusting the drive level value to an exact desired drive level derived from the thermal print head calibration data set for the select one of a plurality of fixed imaging elements;

D. setting the actual drive level value of the select one of a plurality of fixed imaging elements to an integer drive level value closest to the exact floating-point drive level value and storing the remainder difference in a third memory structure so that the remainder difference can be applied to a next selected fixed imaging element; and, E. proceeding to step "A" above, wherein the select one of a plurality of fixed imaging elements is the next selected fixed imaging element, and wherein for every next selected fixed imaging element the exact desired drive level includes the remainder difference as a carry forward sum from the actual drive level of the select one of the plurality of fixed imaging elements.

In another preferred embodiment, the error diffusion process spreads the error down the web of the printing, medium, by carrying the error from scan line to scan line and using the same fixed imaging element. In the preferred embodiment, the error diffusion is spread down the web of the printing medium by carrying the error from the same pixel of the previous scan line to the same pixel of the current scan line. Using this approach you need to store the resulting error of each imaging element uniquely. In a typical application which uses a 600 DPI 12" wide thermal head you would need 7200 unique storage locations to hold the errors, these errors are then added to the appropriate pixel from the next scan line to form the optimal drive level.

Although the present invention his been described with reference to preferred embodiments, workers skilled in the art will recognize that changes may be made in form and detail without departing from the spirit and scope of the invention, as claimed in the following individual claims.

What is claimed is:

1. A method of calibrating a linearly oriented thermal print head, for each scan line of a digitized raster image, comprising the steps of:

A. measuring the electrical resistance of a select one of a plurality of imaging elements with a circuit means for measuring and storing in a first memory structure the value of electrical resistance of the select one of the plurality of imaging elements;

B. deriving a drive level for an image to he printed from a first segment of rasterized data, said first segment of rasterized data based upon a present input value of a raster image data set corresponding to the select one of the plurality of imaging elements;

C. adjusting the drive level to an exact desired drive level derived from the thermal print head calibration data set for the select one of a plurality of imaging elements;

D. setting the actual drive level of the select one of a plurality of imaging elements to an integer drive level value closest to the exact desired drive level and storing the remainder difference in a second memory structure so that the remainder difference call be applied to a next selected imaging element; and, E. proceeding to step "A" above, wherein the select one of a plurality of imaging elements is the next selected imaging element, and wherein for every next selected imaging element the exact desired drive level includes the remainder difference as a carry forward sum from the actual drive level of the select one of the plurality of imaging elements.

2. The method of claim 1, wherein a third memory structure is electrically coupled to the circuit means for measuring the electrical resistance of each imaging element.

3. The method of claim 1, wherein the third memory structure contains at least two discrete thermal print head calibration profiles with at least one of the at least two discrete thermal print head calibration profiles preset during fabrication of the thermal print head and further comprising the step of:

selecting one of at least two print head calibration profiles prior to receiving a thermal print head calibration data set, and wherein the selected print head calibration profile is the thermal print head calibration data set for at least a portion of the plurality of the imaging elements.

4. The method of claim 1, wherein the next selected imaging element is consistently an immediately adjacent imaging element disposed to a common lateral side of the select one of the plurality of imaging elements.

5. The method of claim 4, wherein at a final imaging element which marks a lateral first end of the thermal print head during the execution of step "E" the remainder is set to zero.

6. The method of claim 1, wherein during execution of step "E" the remainder difference that was stored in the second memory structure is carried over until a next scan line is received and then said remainder difference is applied to the same imaging element.

7. The method of claim 1, wherein the method steps are coded into a sequentially executing software program means for operating within a general purpose digital computer.

8. The method of claim 2 wherein the first, second, and third memory structures are each sized to store a data string for each one of said plurality of imaging elements.

9. The method of claim 8, wherein the imaging elements comprise thin film resistive elements closely situated together upon a thermally insulating material substrate and each said imaging clement is electrically coupled in parallel to a common drive value control apparatus.

10. The method according to claim 1, wherein instead of implementing the step A, the following step A' is implemented:

A'. receiving a thermal print head calibration data set for at least a portion of the plurality of the imaging elements, said portion including the select one of the plurality of imaging elements, from a third memory structure.

11. The method of claim 1, wherein the next selected imaging element is consistently an immediately adjacent imaging element disposed to a common lateral side of the select one of the plurality of imaging elements and wherein during execution of step "E" the reminder difference that was stored in the second memory structure is carried over until a next scan line is received and then said remainder difference is applied to the same imaging element.

12. A method of calibrating a thermal print head, comprising the steps of:

measuring the electrical resistance of a first fixed imaging element by applying a known electrical current to all end of said fixed imaging element and evaluating a variation in electrical potential across said fixed imaging element;

receiving a one of a series of rasterized data scan lines, each said scan line composed of a plurality of discrete pixel data drive levels representative of a raster image and corresponding to each of said fixed imaging elements;

receiving a set of head calibration data corresponding to each of said fixed imaging elements of said thermal print head;

adjusting a drive level for each fixed imaging element, one fixed imaging element at time, to a exact desired drive level based upon head calibration data corresponding to each fixed imaging element;

setting all actual drive level for each fixed imaging element to an integer actual drive level closest to the exact desired drive level and storing a remainder difference in a memory structure;

quantizing the actual drive level data;

error diffusing the remainder difference among at least one other of the plurality of fixed imaging elements;

transferring the quantized drive level data to the thermal print head one scan line at a time.

13. The method of claim 12, wherein the error diffusing process step occurs across the thermal print head, thereby distributing an error remainder sum from a first fixed imaging element to the next fixed imaging element until the last fixed imaging element is reached and the error remainder sum is set to zero.

14. The method of claim 12, wherein the error diffusing process step occurs down the web of a printing medium so that an error remainder sum is stored and applied to the same fixed imaging element during successive scan line processing.

15. The method of claim 12, wherein the fixed imaging elements are closely situated upon a thermally insulated substrate and each fixed imaging element is physically and electrically insulated from each other fixed imaging element.

16. The method of claim 13, wherein the fixed imaging elements are disposed upon the thermally insulated substrate member so that less than 100 individual fixed imaging elements are contained within one inch of the thermal print head.

17. The method of claim 12, wherein the error diffusing process step occurs across the thermal print head, thereby distributing an error remainder sum from a first fixed imaging element to the next fixed imaging element until the last fixed imaging element is reached.

18. The method of claim 12, wherein the error diffusion processing step occurs both down the web of a printing medium and across the thermal print head, with a factional portion of the remainder difference at each step applied both to fixed imaging elements of the thermal print head and to a corresponding fixed imaging element in successive scan line processing.

19. A method of calibrating a thermal print head, comprising the steps of:

measuring the electrical resistance of first fixed imaging element by:

applying, a known electrical current to an end of said fixed imaging element; and evaluating a variation in electrical potential across said fixed imaging element;

calculating the electrical resistance of the fixed imaging element; and, storing the resistance value obtained in a first memory structure;

receiving a one of a series of rasterized data scan lines, each said scan line composed of a plurality of discrete pixel data drive levels representative of a raster image processed file and corresponding to each of said fixed imaging elements;

receiving a set of head calibration data containing a plurality of data strings corresponding to each of said fixed imaging elements of said thermal print head;

calculating all exact desired drive level value for each of said fixed imaging elements with reference to at least one of the following: electrical resistance, the discrete pixel data drive level, or the data string corresponding to each fixed imaging element;

adjusting a drive level to the calculated exact desired drive level for each of the fixed imaging elements of said thermal print head;

setting an actual drive level for the one fixed imaging element to an integer drive level value closest to the exact desired drive level value;

storing a remainder difference value representing the delta between the exact desired drive level value and the integer drive level value;

error diffusing the remainder difference among the next selected fixed imaging elements;

transferring the actual drive level to the thermal print head one scan line after a next occurring scan line.

20. The method of claim 19, wherein the next adjacent fixed imaging element is the same imaging element and the comparison step occurs between successive scan line processing.

21. The method of claim 19, wherein the error diffusion step occurs across the thermal print head so that an error remainder sum is carried from a first thermal imaging element to the next adjacent imaging element so that the diffusion processing step distributes the error remainder sum across the print head for each scan line processing step, and wherein the error remainder sum is set to zero prior to beginning a new scan line processing step.

* * * * *